US006233849B1

(12) United States Patent
Gallay et al.

(10) Patent No.: US 6,233,849 B1
(45) Date of Patent: May 22, 2001

(54) SNOWSHOE WITH A RIGID CENTRAL DECK MEMBER

(75) Inventors: Philippe Gallay, La Clusaz; Christophe Burnet, Saint Martin de Bellevue, both of (FR)

(73) Assignee: TSL Sport Equipment, S.A., Alex (FR)

( * ) Notice: Subject to any disclaimer, the term of this patent is extended or adjusted under 35 U.S.C. 154(b) by 0 days.

(21) Appl. No.: 09/237,263

(22) Filed: Jan. 25, 1999

(30) Foreign Application Priority Data

Jan. 26, 1998 (FR) ..... 98 01192

(51) Int. Cl.[7] ..... A43B 5/04
(52) U.S. Cl. ..... 36/122; 36/124; 36/125
(58) Field of Search ..... 36/122, 123, 124, 36/125

(56) References Cited

U.S. PATENT DOCUMENTS 2,511,087 * 6/1950 Villemur ..... 36/124
2,618,869 * 11/1952 Wincentsen ..... 36/125
2,738,596 * 3/1956 Walsh ..... 36/124
3,555,707 * 1/1971 Sharratt et al. ..... 36/123
5,540,002 * 7/1996 Liautaud ..... 36/122
5,787,612 * 8/1998 Mahoney et al. ..... 36/122 X
5,809,668 * 9/1998 Kiniry et al. ..... 36/122
5,884,933 * 3/1999 Trott ..... 36/122 X
5,887,362 * 3/1999 McKenzie ..... 36/124

* cited by examiner

*Primary Examiner*—Paul T. Sewell
*Assistant Examiner*—Anthony Stashick
(74) *Attorney, Agent, or Firm*—Fay, Sharpe, Fagan, Minnich & McKee, LLP

(57) ABSTRACT

A snow shoe (1) includes a tubular frame (2) defining an interior zone. A deck (4) which is surrounded by the frame is made in part of a film (3). A binding (7) retained on the deck for securing the boot of the user. A central technical bottom piece (15) enhances the traction and floatation properties, as well as the comfort of the snowshoe (1). The central technical bottom piece (15) which is arranged along the central portion of the tubular frame (2) includes a traction surface having lateral longitudinal traction portions (18*a*, 18*b*) extending vertically from the frame (2), in this manner, the traction characteristics in the transverse direction are enhanced. The traction portions (18*a*, 18*b*) may comprise lateral walls, spikes, blades, or the like. The traction portions (18*a*, 18*b*) extend in the downward direction from the outer edge of the snowshoe rather than from the middle areas of the snowshoe (1) to increase the comfort of the shoe (1). In addition, the central technical bottom piece (15) includes at least one transverse wall (40) extending horizontally between the lateral traction portions (18*a*, 18*b*) to provide support beneath the heal of the user and to enhance the traction properties.

18 Claims, 10 Drawing Sheets

SNOWSHOE WITH A RIGID CENTRAL DECK MEMBER

The present invention concerns an improvement for a snow shoe intended to ameliorate the comfort and traction of the snow shoe for the user and, more specifically, with respect to snow shoes of the type comprising a tubular frame and a deck, realized at least in part of film, the invention likewise concerns a manufacturing method of this type of snow shoe, said method being intended to permit the manufacture of a range of different shoe sizes.

Snow shoes are devices which have been known for a great many years because they have been employed for several hundred years by the Scandinavian people in order to travel on snow. Up to now, the snow shoes were used for utilitarian or military purposes in order to permit people or mountain troops to move on snow in their daily travel requirements. Currently, snow shoes are preferably used by walkers or athletes who undertake cross-country runs or walks, and even partake in competitive events. However, athletes and recreational users are becoming more and more demanding with respect to the equipment they use and it is a fact that the products currently sold are not entirely satisfactory.

Many types of snow shoes are known comprising a tubular frame supporting a deck made of thin film, such shoes generally being the snow shoes used in North America. However, these shoes present numerous drawbacks linked to their traction in certain types of terrain and, above all, under certain snow conditions. In fact, if these shoes are well adapted to the terrain, they require much floatation such as in newly fallen snow, they somewhat lack in traction on sloping surfaces or terrain where the snow is harder, for example. The traction problems have caused certain manufacturers to install under the film, spikes or other blades. The achieved results, however, are less than satisfactory. Moreover, they also present problems in regard to comfort connected with the means of retention or the bindings of the boot.

It is the object of the present invention to eliminate these aforementioned drawbacks with the aid of means which can be arranged in simple, reliable, safe and uncomplicated fashion. The object of the invention is to present a snow shoe which has a great floatation as well as excellent traction properties, permitting the user to perform regardless of the type of terrain or type of snow while benefiting, at the same time, also from increased comfort.

Thus, the snow shoe according to the invention is of the type constituted by a frame formed by at least a portion of a structural shape, and a deck, and is characterized in that it comprises a central technical bottom piece, realized of rigid material, fixed to the frame.

According to an additional property, the central technical bottom piece is arranged in the central zone, in the deck of the snow shoe, between two portions of the lateral structural shapes of the frame.

According to a specific embodiment of the snow shoe, the central technical bottom piece is arranged, at least in part, in a horizontal plane, situated under the horizontal plane in which a film is arranged which forms at least a portion of the deck.

According to another characteristic, the snow shoes comprises a binding intended to retain the boot of the user and arranged on the upper surface of the central technical bottom piece.

According to a specific embodiment of the snow shoe according to the invention, the binding comprises an articulated plate supporting the retention means of the boot, said plate being articulated according to a transverse axis on the central technical bottom piece.

According to an additional feature of the snow shoe in accordance with the invention, it is characterized in that the central technical bottom piece comprises on its lower surface, means of traction.

According to a specific embodiment of the snow shoe, the traction means are constituted by a set of lower traction walls, arranged laterally and/or transversely beneath the central technical bottom piece, the lower edges of said walls extending beneath the horizontal plane which comprises the lower rim of the structural shape portions forming the frame.

According to a variation of the embodiment of the snow shoe according to any one of the claims, the frame and the central technical bottom piece show a contraction in width in the central zone of the deck.

According to other additional characteristics, the frame is of different material from the material of the central technical piece, and the frame is, for example, of metal and is realized by a tubular section in order to form a peripheral tube, while the central technical bottom piece is realized of plastic.

According to another characteristic of the snow shoe according to the invention, the central technical bottom piece is realized of plastic, such as polypropylene or polyamide, for example.

According to a complementary characteristic of the snow shoe according to the invention, the deck is constituted, at least in part, by a film fastened to the frame and/or to the central technical bottom piece.

In addition, the invention likewise concerns a manufacturing method of a related snow shoe, which is characterized in that it comprises a principal stage, consisting of realizing a central technical bottom piece, made of plastic material, intended for installation in several tubular frames of different dimensions without alteration to its own dimensions.

Other characteristics and benefits of the invention are apparent from the description given below, pertaining to the attached drawings, which are provided by way of example only but are not limited thereto.

FIGS. 1 to 6 illustrate a first specific embodiment of the snow shoe.

FIG. 2 illustrates the snow show in lateral view.

FIG. 3 illustrates the snow show in view from above without binding.

Figure 4A:
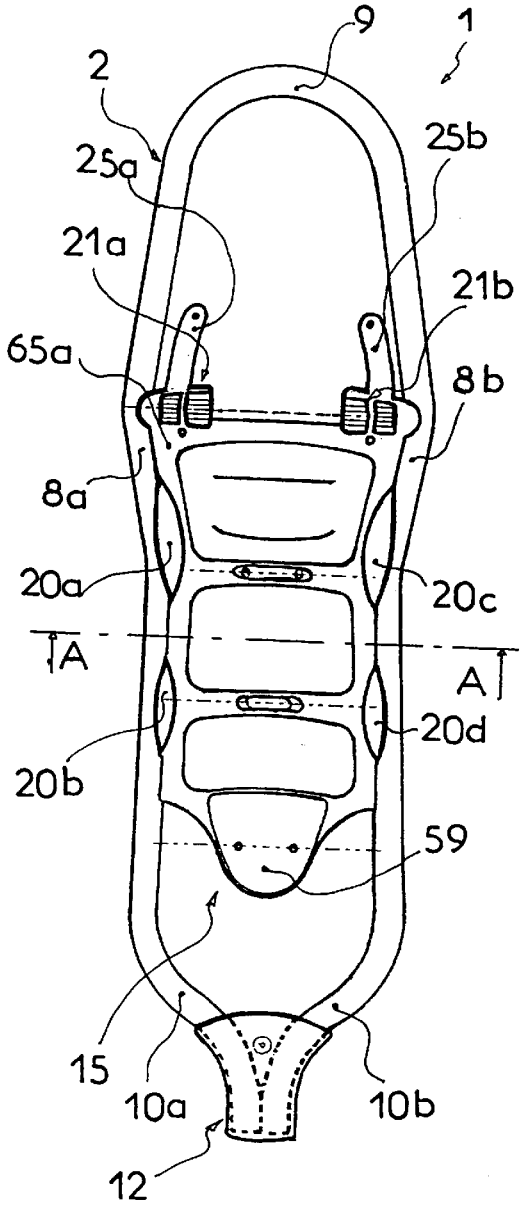

FIG. 4*a* represents a bird's eye view of the snow shoe without the film.

Figure 4B:
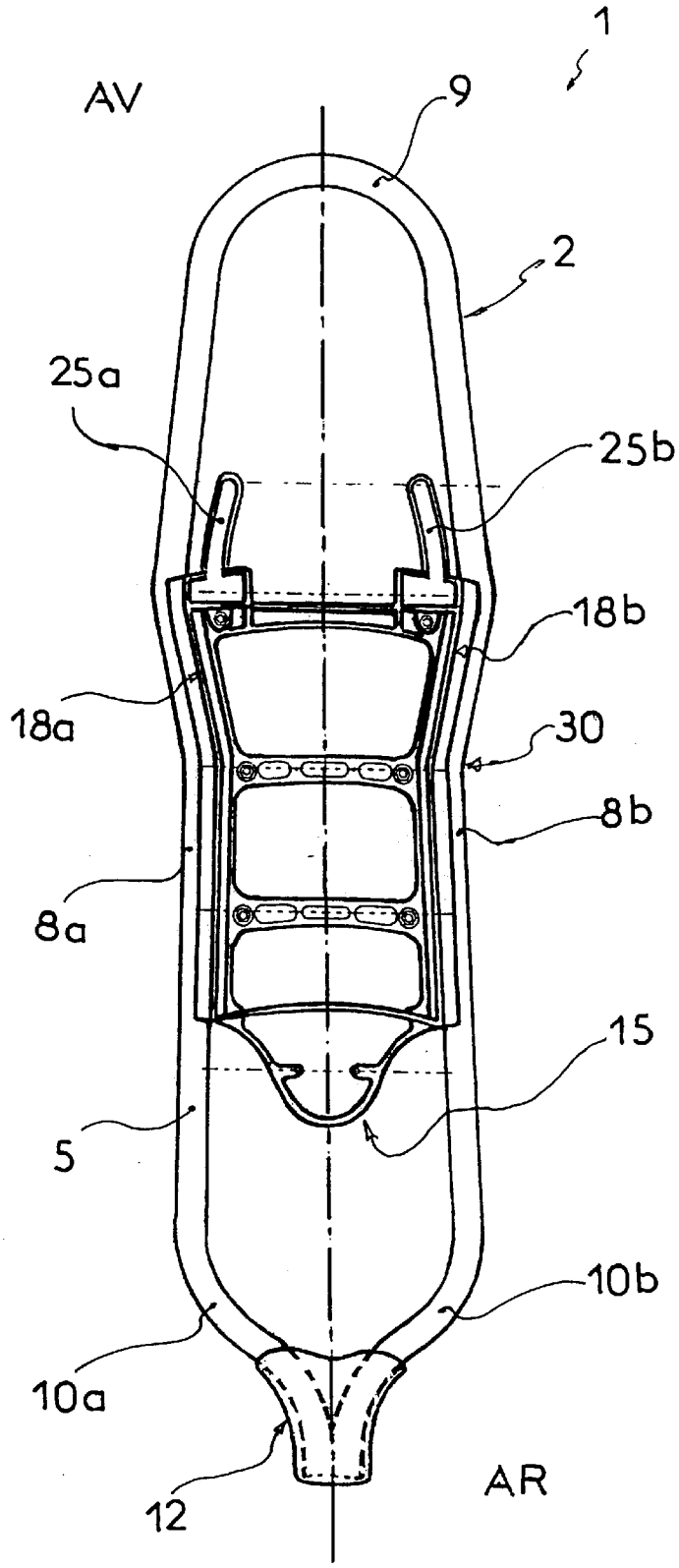

FIG. 4*b* represents a view from below of the snow shoe without the film.

Figure 5:
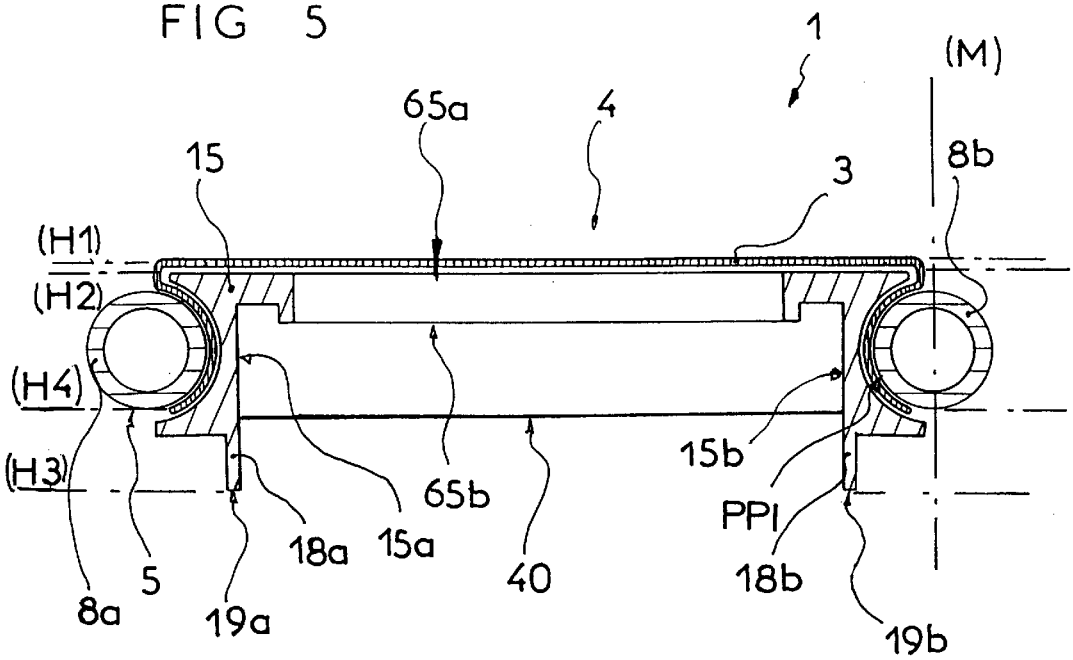

FIG. 5 represents a transverse section according to AA of the snow shoe according to the invention.

Figure 6:
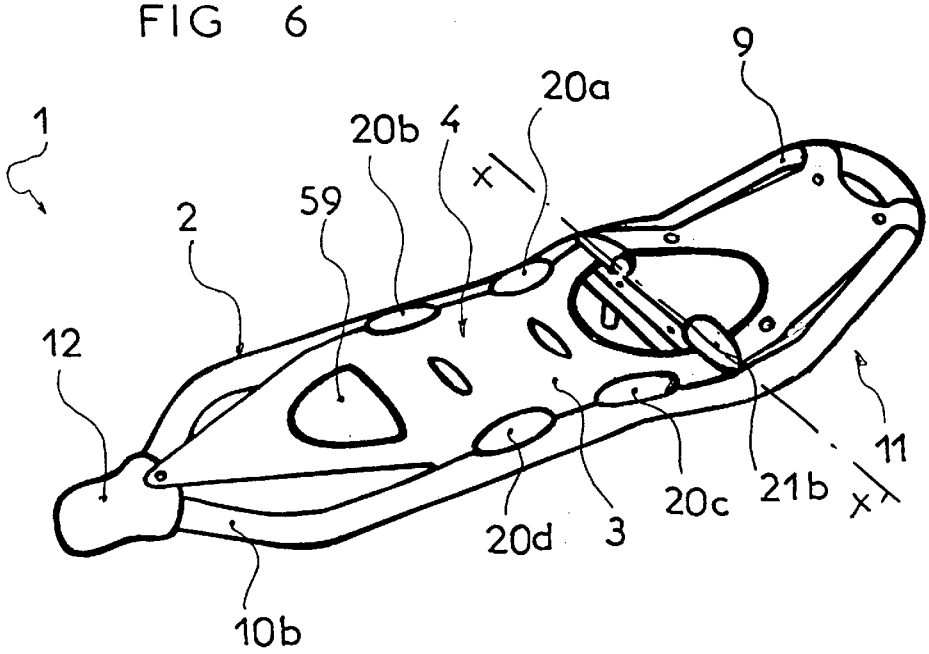

FIG. 6 depicts a perspective view of the snow shoe with its binding.

Figure 7:
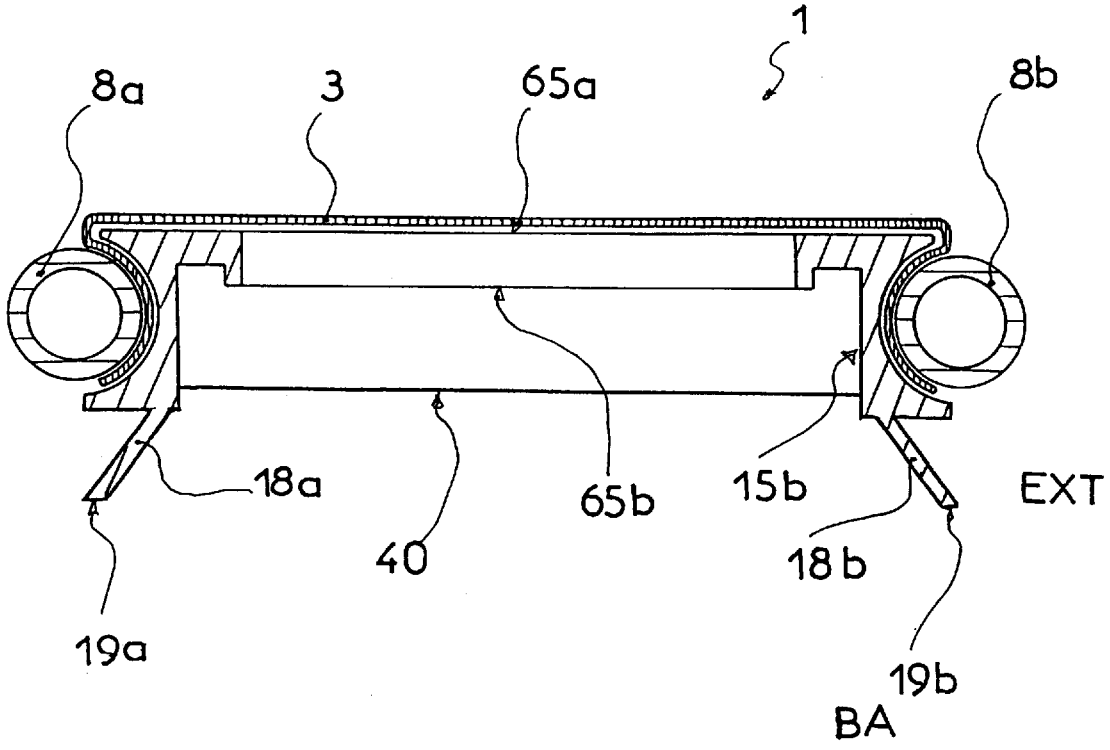

FIG. 7 represents an execution variation in transverse section according to a view similar to FIG. 5.

Figure 8A:
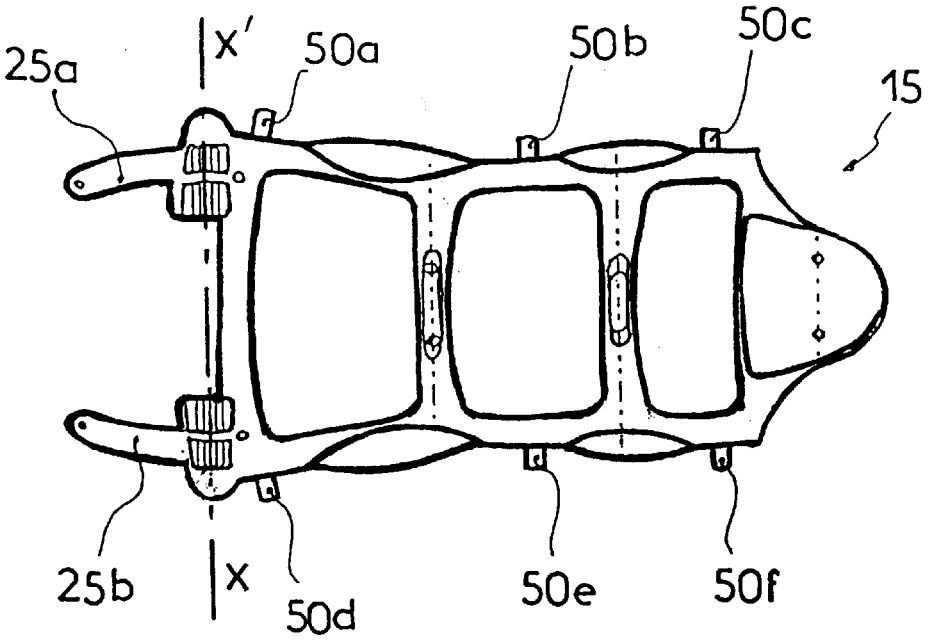

FIG. 8*a* illustrates an execution variation of the central technical bottom piece viewed from above.

Figure 8B:
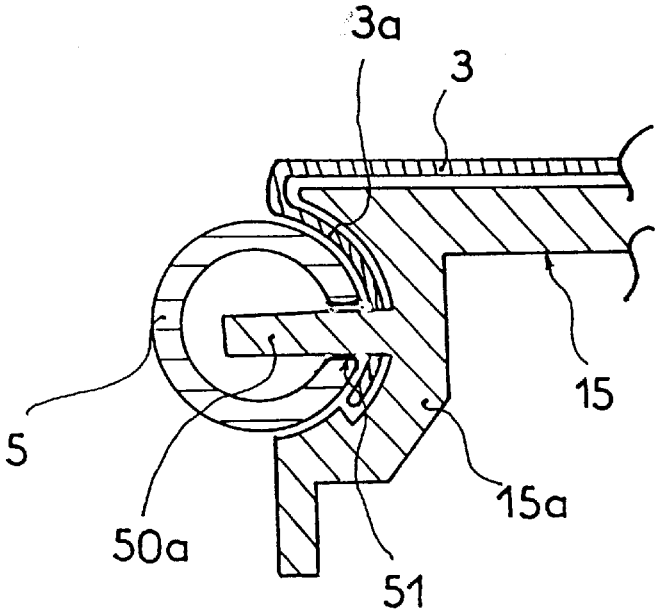

FIG. 8*b* illustrates in transverse section a fastening detail of the film according to said second execution variation.

Figure 3:
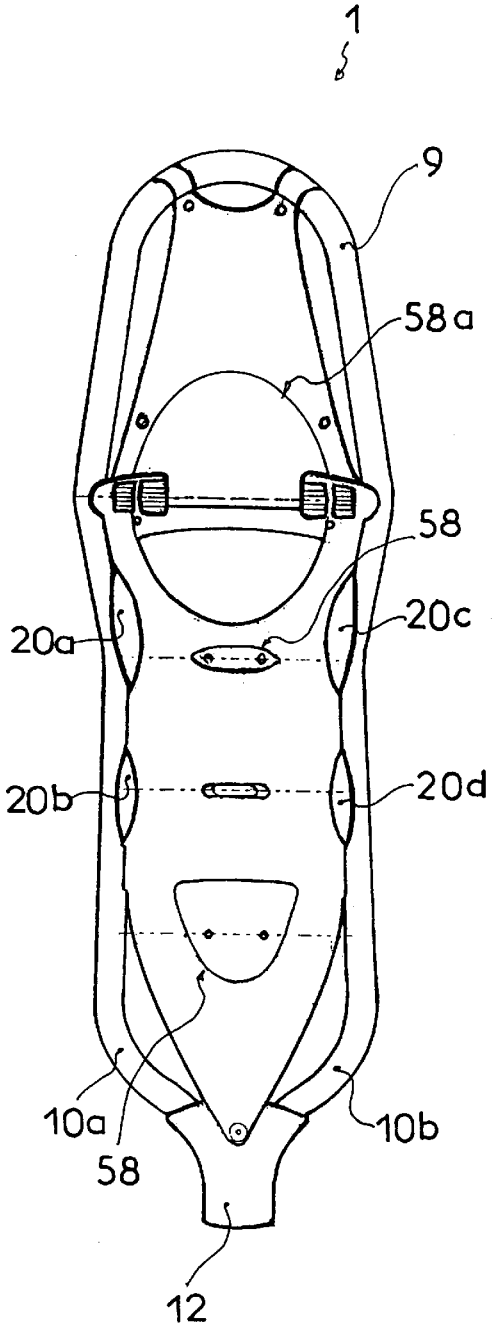
Figure 9A:
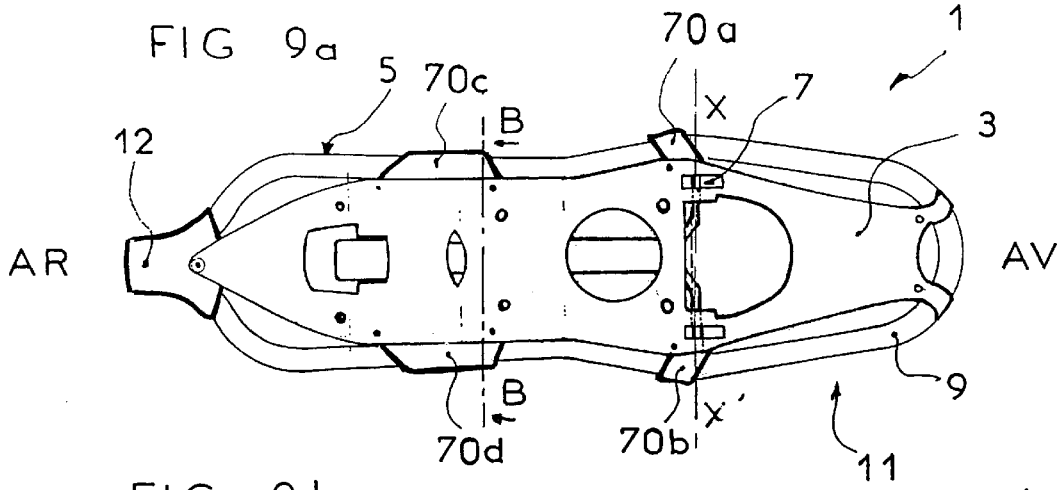
Figure 9B:
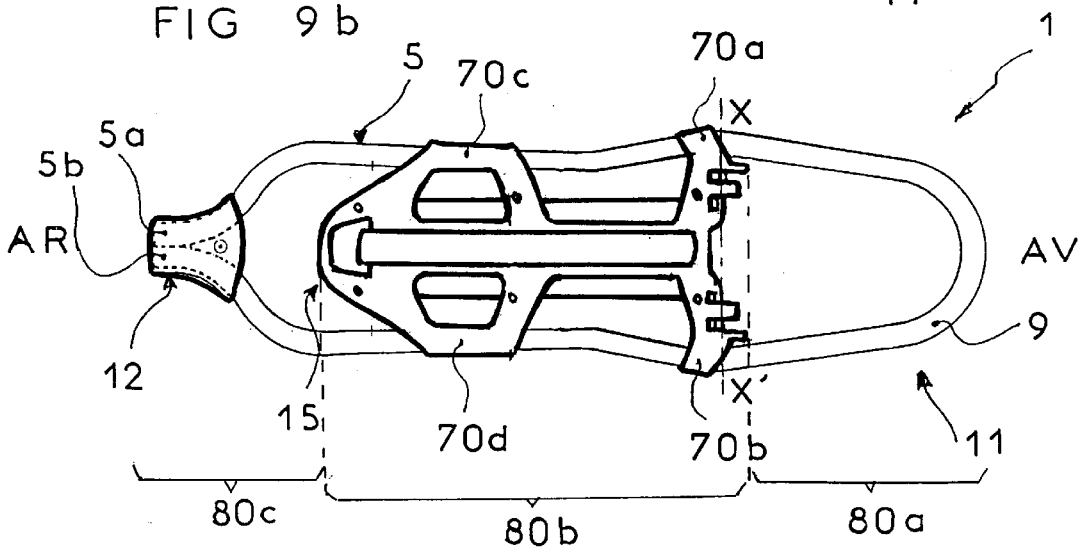

FIGS. 9*a* and 9*b* respectively illustrate a second embodiment of the snow shoe according to views similar to those in FIGS. 3 and 4.

Figure 9C:
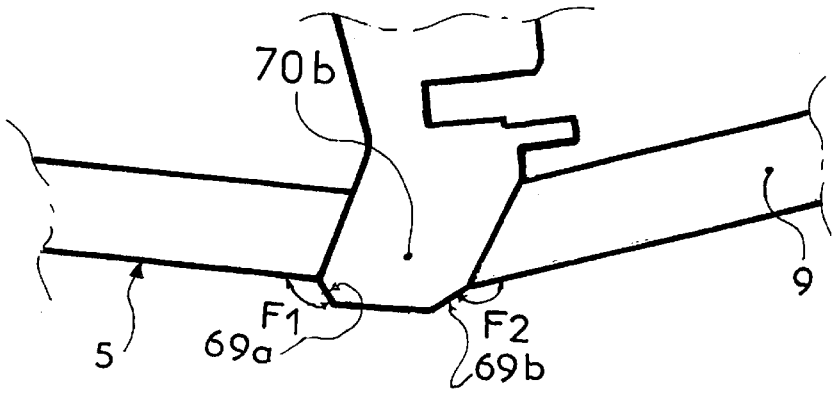

FIG. 9*c* illustrates in bird's eye view of a connection detail between the central technical bottom piece and the frame.

Figure 10:
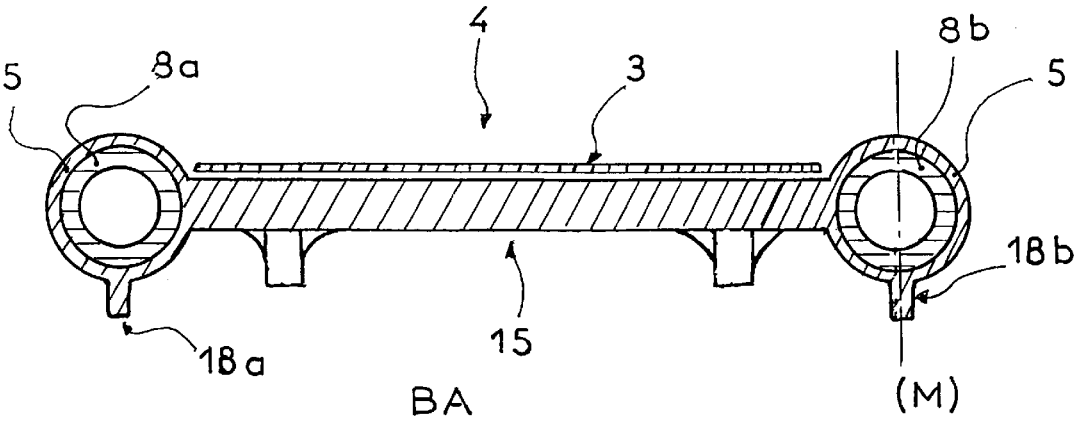

FIG. 10 illustrates in transverse section according to BB said second embodiment of the snow shoe.

Figure 11A:
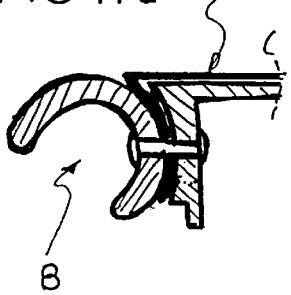
Figure 11B:
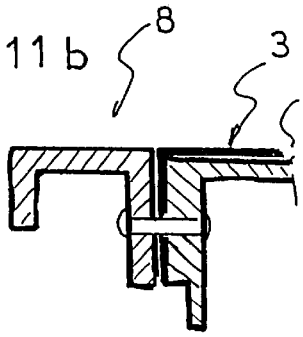
Figure 11C:
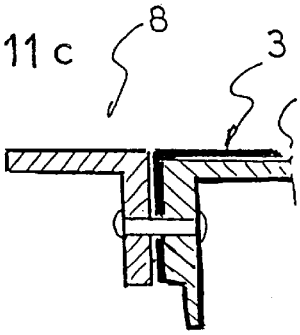

FIGS. 11*a*, 11*b*, 11*c* illustrate other embodiments of the peripheral frame.

Figure 12A:
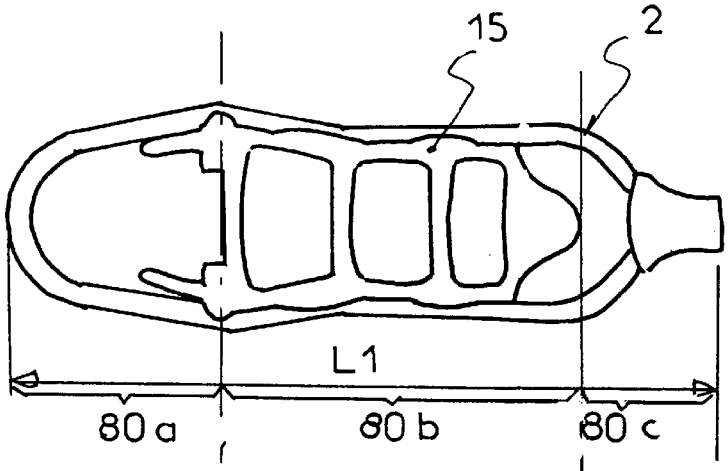
Figure 12B:
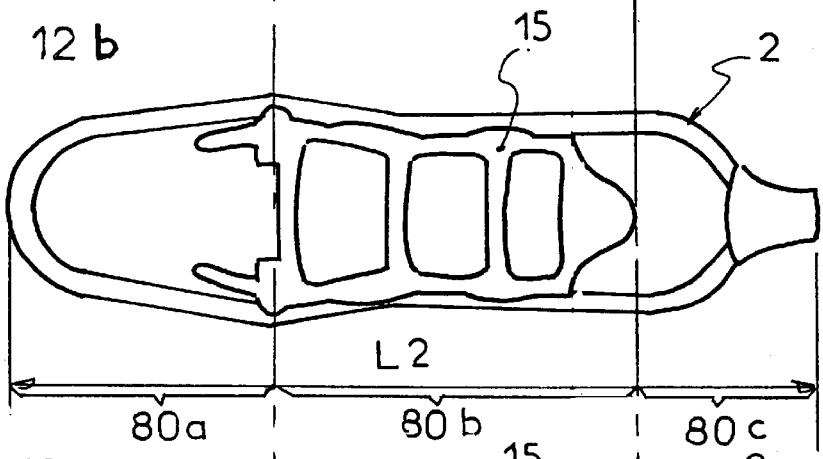
Figure 12C:
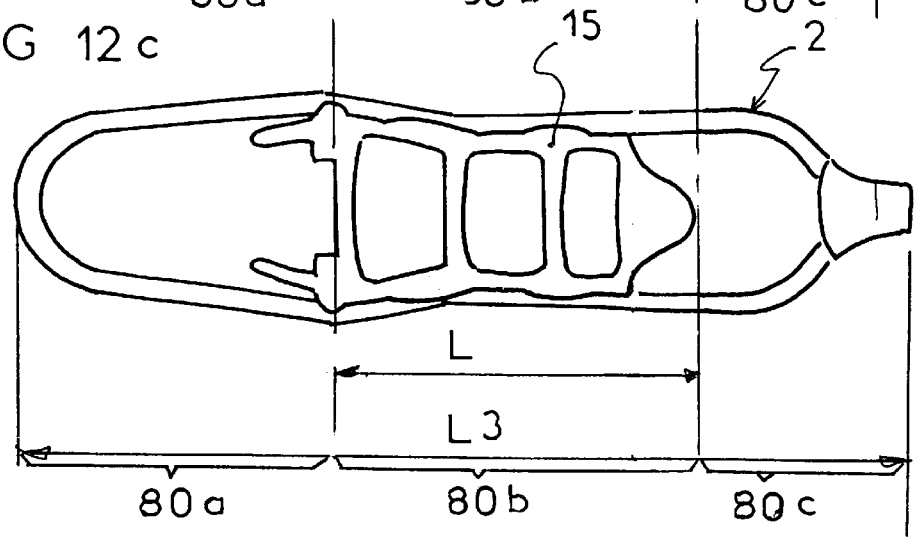

FIGS. 12*a*, 12*b*, 12*c* indicate three different frame lengths, having the same central technical piece.

Figure 13:
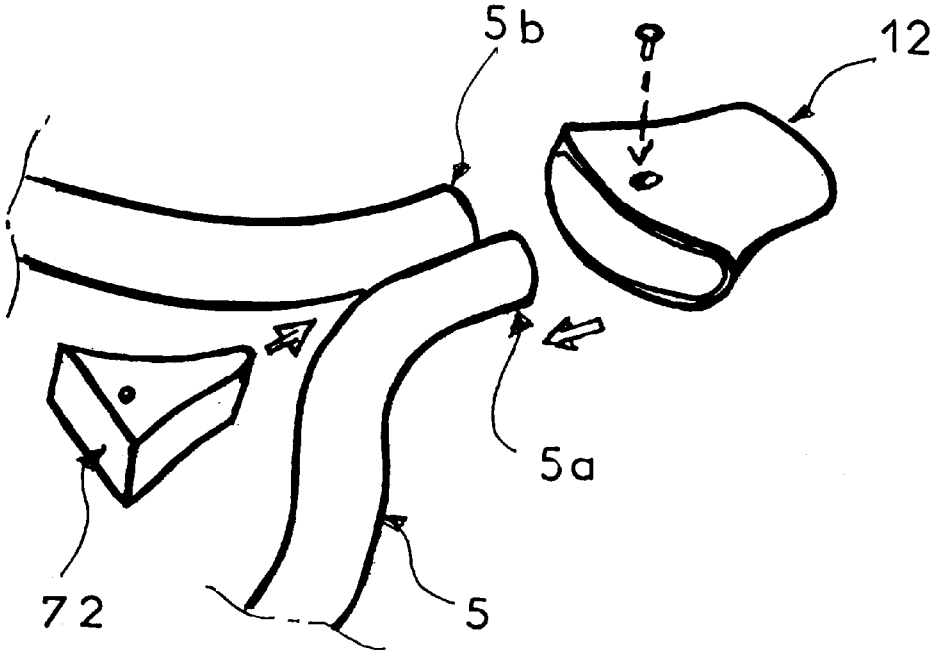

FIG. 13 illustrates in perspective the tube assembly through the tip of the tail.

Figure 14:
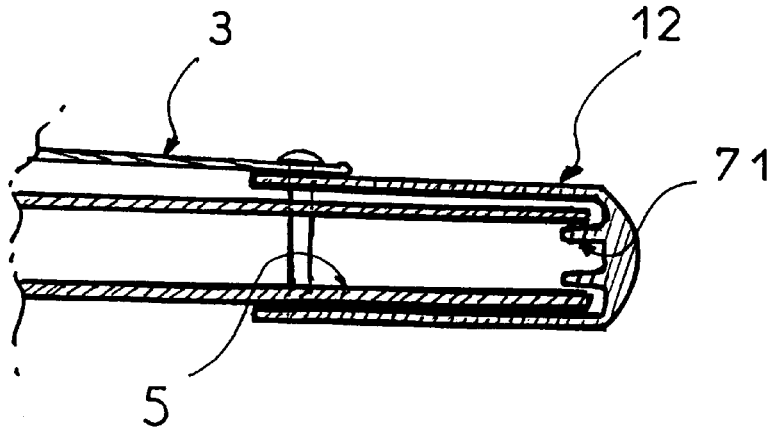

FIG. 14 represents in longitudinal section the end of the tube and its tail tip.

Figure 1:
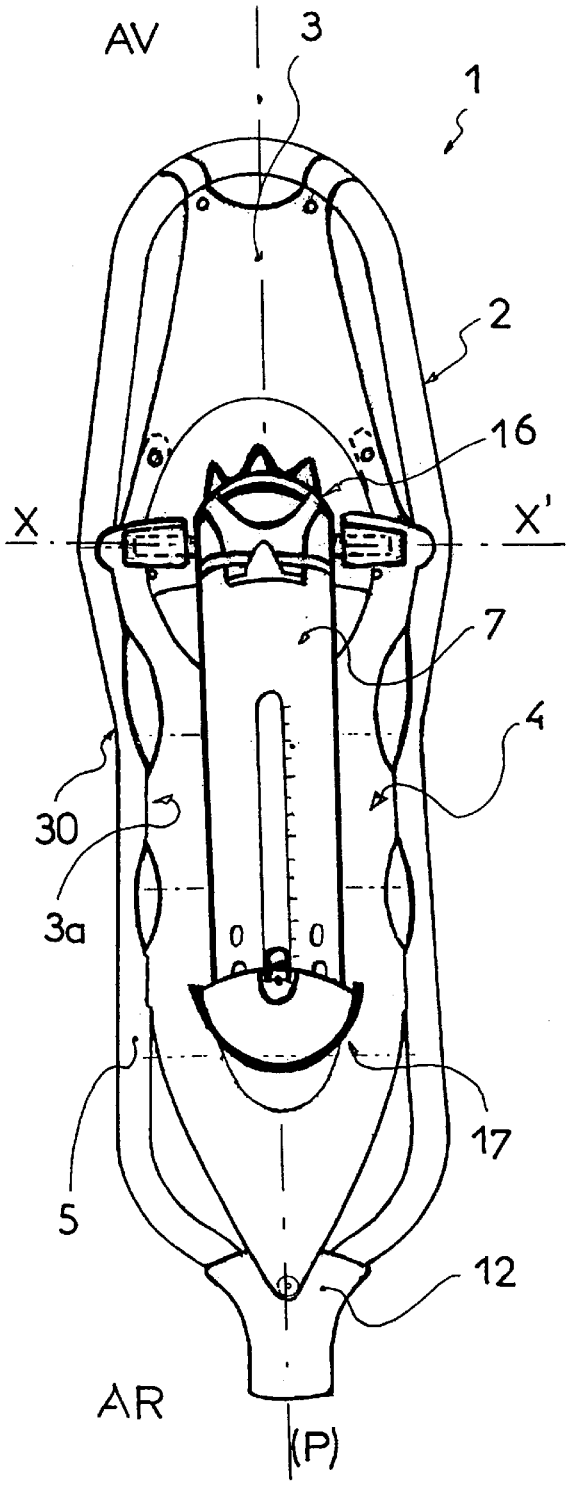
FIGS. 1 to 14 illustrate several specific embodiments of the snow shoe according to the invention and different execution variations.

The actual snow shoe, bearing the general reference (1) is constituted by a frame (2), delimiting a deck (4) destined to receive the boot of the user, said boot being retained on the deck by a binding (7). The deck (4) can be realized, at least in part, by a film (3), the edge of which is destined to be fastened in several places to the frame (2), said frame being formed by at least a part of the structural shape (8*a*, 8*b*) constituted, for example, by tubes (5), beneficially made of metal as illustrated in FIG. 1. It goes without saying, however, that the portions of the structural shape forming the frame could also present different shapes, as indicated by the variations in execution illustrated in FIGS. 11*a*, 11*b* and 11*c*, without going beyond the scope of protection of the invention.

Figure 2:
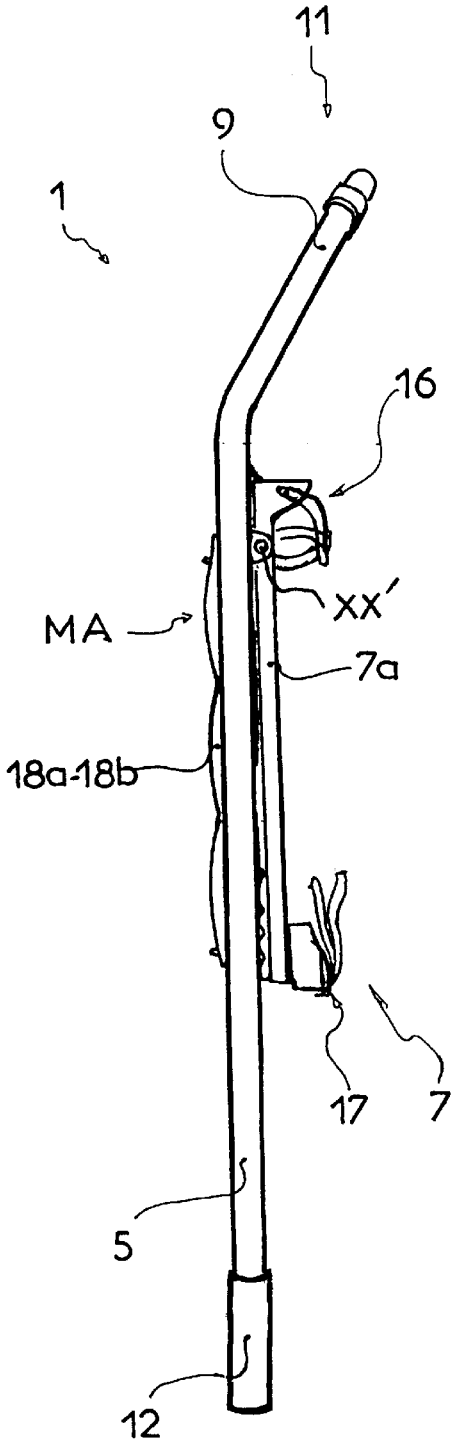

According to the illustrated embodiments of the snow shoe (1) according to the invention, these have a longitudinal plane of symmetry (P), the frame (2) is beneficially of tubular type comprising thus two portions of lateral tubes (8*a*, 8*b*) connected in the front (AV) by a portion of the front tube (9) extending the lateral tubes and forming a spatula (11), beneficially raised and connected to the rear (AR) by two rear tube portions (10*a*, 10*b*), which extend the lateral tubes and which rejoin each other in the back, the extremities of said rear tubes being fastened together by a tail tip (12). The lateral tubes thus border a deck zone called central zone and which is destined to be occupied by the boot of the user as indicated in FIGS. 2 and 3.

According to the invention, the snow shoe comprises a central technical bottom piece (15) realized of rigid material such as, for example, plastic material or aluminum, said piece permitting, in addition, to beneficially increase the floatation and the traction property of the snow shoe. The central technical bottom piece (15) is beneficially arranged between the two lateral tube portions (8*a*, 8*b*) in the central zone of the deck (4) corresponding to the zone occupied by the boot, as shown in FIGS. 4*a* and 4*b*.

According to the invention, the central technical bottom piece (15) occupies only the central zone (80*b*) of the deck (4), i.e. the zone occupied by the boot, it leaves free the front (80*a*) and rear (80*b*) zones as indicated by the different embodiments and execution variations, and specifically those shown in FIGS. 12, 12*b* and 12*c*. The front and rear zones are beneficially occupied by a film (3) in such manner so as to slightly increase the floatation of the snow shoe.

The central technical bottom piece (15) is a rigid independent piece destined to be fastened to the frame (2) thanks to locking means, for example, as indicated by the first embodiment and its variations, or directly fixed by cast-moulding as illustrated in the second embodiment.

According to the first embodiment of the snow shoe according to the invention, the central technical bottom piece (15) has the shape of a perforated plate, whose lateral edges (15*a*, 15*b*) are formed by two lateral walls destined to position themselves against the lateral tubes (8*a*, 8*b*) of the frame (2) and beneficially against the peripheral internal wall (PPI) of same, i.e. against the wall situated towards the interior of the deck (4) in comparison to the median vertical plane (M) of the tubes (5). It should be noted that the external surface of the lateral walls has, at least in part, a shape which is complementary to the shape of said internal peripheral wall of the tube to which it is going to be fastened.

Thus, according to said first embodiment of the snow shoe and as indicated in FIG. 5, the technical bottom piece (15) presents, at the level of its lateral sides (15*a*, 15*b*) a hemi-cylindrical profile, open toward the exterior, complementary to the tube profile (5), said complementary profile being destined to lend some support toward the integrality of the internal peripheral wall (PPI) of the tube. It is self-understood that said lateral sides could present a slightly reduced symmetrical cylindrical profile in comparison to the median horizontal plane of the tube portions (8*a*, 8*b*) of the shoe (1). It is self-understood that the central technical bottom piece could come to cooperate in different fashion vis-a-vis portion of the lateral tubes of the frame such as, for example by being likewise fixed against the external peripheral wall as demonstrated by the second embodiment illustrated in FIGS. 9*a*, 9*b* and 10, without going outside the protective field of the invention.

According to the first embodiment of the snow shoe according to the invention, the binding (7) of the snow shoe is arranged on the upper surface (65*a*) of the central technical bottom piece (15) and is beneficially constituted by a plate (7*a*) articulated around a transverse axis (XX') relative to said technical piece, the plate (7*a*) supporting the front retention means (16) and the rear retention means (17) destined to retain the boot of the user.

It should be noted according to the first realization mode illustrated in FIG. 5, that the film (3) constituting, at least in part, the deck (4) is situated in a horizontal plane (H1) located above the horizontal plane (H2) containing the upper face of the central technical bottom piece (15). Thus the technical piece (15) is concealed, at least in part, by the film (3) when the snow shoe (1) is viewed from its upper surface. However, the film beneficially presents openings (58) which allows the technical piece (15) to be visible. Certain portions of said technical bottom piece arranged in said openings (58) present their upper surface in the plane (H1) of the film or in a plane located above said plane (H1). These portions are, for example, a rear support wall (59) of lateral projections (20*a*, 20*b*, 20*c*, 20*d*) or the articulation slots (21*a*, 21*b*) into which parts of the integral axis of the articulated plate (7*a*) are destined to be introduced in order to obtain the articulation of the binding around the transverse axis (XX') as represented in FIGS. 2, 3 and 4*a*.

According to the first embodiment of the snow shoe (1), the articulation slots (21*a*, 21*b*) are arranged at the front extremity of the central technical bottom piece (15), to the rear of an opening (58*a*) of the tail film (3), sufficient in order to permit pivoting of the front extremity of the plate (7*a*) which is fitted with the user's boot.

According to the first embodiment of the snow shoe according to the invention, the central technical bottom piece (15) comprises, on its lower surface (65*b*) traction means (MA), destined to reinforce the traction characteristics of the snow shoe (1), specifically in transverse direction. These traction means can be constituted, for example, by lateral longitudinal wall portions (18*a*, 18*b*), with at least a portion of the lower edge (19*a*, 19*b*) being arranged in an approximate horizontal plane (H3) situated beneath the horizontal plane (H4) containing the lower edge of the tube in the central zone of the frame (2) as illustrated in FIG. 5. It goes without saying that the traction means can likewise comprise spikes, blades or any other equivalent traction means without going outside the protected field of the invention.

It should also be noted that the lower edges (19*a*, 19*b*) of the sides of the central technical bottom piece (15) can beneficially be serrated or have teeth in order to reinforce the traction of the snow shoe in longitudinal direction. According to the illustrated embodiment, the central technical bottom piece (15) comprises, on its lower surface (15*b*) transverse traction walls (40). These transverse walls (40) represented in FIGS. 5 and 7, the lower edge of which extends between two lateral edges (18*a*, 18*b*), approximately in the horizontal plane (H4), could also be arranged in a horizontal plane (H5)—not shown—situated beneath the horizontal plane (H4) containing the lower edge of the frame (2), said plane (H5) can, for example be merged with the horizontal plane (H3) which contains the longitudinal edges (19*a*, 19*b*).

According to the first embodiment of the snow shoe, the central technical bottom piece (15) comprises two transverse walls, one being arranged at the front of said piece, approximately at the level of articulation of the plate (7*a*), while the other wall is arranged at the rear beneath the rear support wall (59) with the rear end of the articulated plate being destined to provide support beneath the heel of the user. It goes without saying that the number, the position, the longitudinal position as well as the shape of the transverse traction walls can be different without going outside the protected field of the invention. In addition, according to this embodiment, the longitudinal lateral walls (18*a*, 18*b*) can be discontinued and constituted each by three wall portions as shown in FIG. 2. Moreover, according to an execution variation illustrated in FIG. 7, the lateral traction walls (18*a*, 18*b*) can be inclined relative to the longitudinal vertical reference plane (P) and present, for example, an inclination toward the exterior (EXT) and toward the bottom (BA) relative toward said plane.

According to the first embodiment of the snow shoe according to the invention, the film (3) which constitutes at least part of the deck (4) is fastened on the tubular frame (2) thanks to the central technical bottom piece (15) which permits wedging, in several places, of the edge of the film between the lateral edges (15*a*, 15*b*) of the internal peripheral wall (PPI) of the tube (5). In addition, the attachment of the tubular frame (2) to the technical bottom piece (15) which permits, beneficially, the fixation of the foil, can also be effected with the aid of locking means, such as for example, rivets which hold the piece against the tube, without emerging on the side of the external peripheral wall of the tube.

It should be noted that according to this first embodiment, the central technical bottom piece (15) can constitute, in part, attachment means of the film (3) to the tubular frame (2). Furthermore, the central technical bottom piece (15) comprises film tension means destined to permit stretching and shaping of the foil, specifically the longitudinal profile of the shoe,—these means can be constituted by two front extensions (25*a*, 25*b*) which extend in the front zone (80*a*) of the snow shoe and on which the film can be riveted in such manner so as to be shaped according to the inclined or curved form of the spatula (11).

According to an execution variation of the snow shoe illustrated in FIGS. 8*a* and 8*b*, the locking means (MV) destined to permit the attachment of the central technical bottom piece (I5) to the frame (2) are constituted by tabs (50*a*, 50*b*, 50*c*, 50*d*, 50*e*, 50*f*) destined to cooperate with the complementary slots (51) of tube (5). According to this embodiment, said cooperation is based on applying portions of the lateral tubes (8*a*, 8*b*) of the frame, against each other in such manner so as to arrest the central technical bottom piece (15), said application can beneficially be obtained thanks to the tip of the tail (12) which permits fastening together the free extremities of the tube (5) forming the frame (2).

According to the first illustrated embodiment of the snow shoe (1) according to the invention, the lateral edges (15*a*, 15*b*) of the central technical bottom piece (15) and the portions of the lateral tubes (8*a*, 8*b*) of the frame (2) show a contraction in width (30) in the central zone of the deck (4). The contraction is beneficially situated longitudinally in the middle of the central zone destined to receive the foot of the user. It goes without saying that the lateral traction walls (18*a*, 18*b*), extending the lateral edges (15*a*, 15*b*) in downward direction, also have a corresponding central contraction; however, there may also be straight parallel lateral walls between them without going outside the protected field of the invention.

According to the illustrated embodiment of the snow shoe (1), the central technical bottom piece (15) is made of plastic material via any type of manufacturing process, such as, for example, casting, by injection or by extrusion. The employed plastic material can be constituted, for example, by a polyamide or by a propylene.

According to a second embodiment of the snow shoe (1) according to the invention, illustrated in FIGS. 9*a*, 9*b* and 10, the central technical bottom piece (15) is made of plastic material and its attachment to the frame is obtained directly by over-casting the lateral profiles (8*a*, 8*b*). Thus, as depicted in FIGS. 9*b* and 10, the central technical bottom piece (15) is realized by injection in such manner so as to hold captive the tube (5) which forms the frame (2) on the inside of cylindrical sleeves by at least two points of fixation and preferably four (70*a*, 70*b*, 70*c*, 70*d*). It should be noted that according to this embodiment, the two lateral fixation points are arranged on all sides of the contraction in width (30) of the central zone, the front fixation points (70*a*, 70*b*) being longitudinally positioned at the level of the articulation axis (XX') of the binding (7) and the rear points (70*c*, 70*d*) at the rear extremity of the central zone (80*b*). It is self-understood that the placement and the number of fixation points can be different without going outside the protected field of the invention. Thus, binding can be obtained by two lateral sleeves, over-cast around the tube on all sides of the technical bottom piece over the totality of its length, for example. In addition, it is important to note, as shown in detail in FIG. 9*c*, that the sleeves (70*a*, 70*b*, 70*c*, 70*d*,) forming the fixation points, have lateral chamfers (69*a*, 69*b*) in such manner so as to respectively form, together with the lateral profiles (8*a*. 8*b*) obtuse angles (F1, F2). Thus, the edges of the snow shoe do not have any lateral projection which is likely to grab an exterior element or grab another snow shoe while in motion.

According to the second embodiment of the snow shoe according to the invention, the foil (3) is no longer attached to the shoe with the aid of the central technical piece, but is attached, at least in part, directly to said technical piece. Consequently, as depicted in FIG. 9*a*, the foil (3) is attached, for example, by rivets to the upper surface (65*a*) of the central technical bottom piece (15) and to the tip of the tail (12) and is attached in known fashion, forming a loop at the level of the spatula (11). However, the attachment of the foil in front can also be done on a complementary front attachment piece, which is rigid and an integral part of the front tube portion that forms the spatula, said complementary piece being able to be attached to the spatula by mould-duplication.

It should be noted as well, that the central technical bottom piece (15) also has, according to this second embodiment, lateral wall portions (18*a*, 18*b*) which extend beneath the deck (4) of the snow shoe and which form its traction means. According to said second embodiment, these walls are beneficially positioned beneath the lateral cylindrical sleeves of the central technical piece which hold captive the tube and which form the attachment points (70*a*, 70*b*, 70*c*, 70*d*). The traction walls (18*a*, 18*b*) can thus extend in downward direction (BA) along these sleeves in the median plane (M) of tube (5) as represented in FIG. 10.

According to the invention, the frame (2) is formed by a single tube, which is shaped, for example, by bending, and whose extremities (5*a*, 5*b*) are attached together at the rear extremity of the snow shoe (1) as indicated in FIG. 4*a*. The attachment means of the extremities of the tubes (5*a*, 5*b*) can be of any type. They can specifically be obtained by a rear end piece or end tip for tail (12) which holds fast the two tube extremities. Consequently, as indicated in FIGS. 13 and 14, the tip of the tail (12) can beneficially present the tightness means in the form of two internal cylindrical projections (71) destined to seal each tube extremity in order to prevent snow or water from entering. In addition, once the tail tip (12) has been firmly installed on the end of the tubes, an additional tightness and attachment piece (72) in form of a wedge is going to fill the space left open at the tip of the tail (12). Said complementary piece (72) is riveted, for example, at the tip of the tail (12), with attachment by rivet likewise permitting attachment of the rear extremity of the film (3) on the tip of the tail (12).

It is important to note that the central technical bottom piece (15) occupies only the central zone (80*b*) of the deck (4) of the snow shoe according to the invention (1) and that it leaves the front zone (80*a*) corresponding to the spatula and the rear zone (80*c*) totally free. In this manner the portions of the lateral profiles (8*a*, 8*b*) extend on all sides of the central bottom piece (15) toward the front in order to form the spatula and toward the back in order to come together at the rear tip in such fashion so as to determine a front zone and a rear zone between the frame and central technical bottom piece (15)—these zones left free by the central technical bottom piece (15) are beneficially occupied by the film (3).

Thus, according to the different embodiments depicted with respect to the snow shoe according to the invention, the frame is formed by a single tube, whose extremities are fastened together by the tip of the tail, permitting avoidance of problems due to assembly of several tube portions by firmly joining, welding or by other means, which may cause, for example, at the junction places, weak spots, corrosion problems or tightness problems.

In addition, the invention also concerns a fabrication process of a snow shoe of the previously described type. According to this process, the principal fabrication stage of the snow shoe (1) consists of realizing a central technical bottom piece (15) of rigid material, such as, for example, by a plastic injection process, said piece being destined for installation into several tubular frames having different dimensions without modifying its own dimensions. In this manner the process permits obtaining a range of different size snow shoes by utilizing the same central technical bottom piece in order to specifically reduce the production costs by having only one injection mould size which can be utilized for fabrication of snow shoes in different sizes. FIGS. 12*a*, 12*b*, 12*c* illustrate three snow shoes of different lengths (L1, L2, L3) whose central technical piece is identical having the length L. Thus, the process also consists of realizing, for example, via bending, a frame whose spacing of lateral tube portions (8*a*, 8*b*) in the central part is equal to the width of the technical bottom piece (15) regardless of form and dimensions of other parts of the tubular frame (2). According to an execution variation of the process, the mould destined to realize the central technical bottom piece by injection is a mould duplication mould into which one places the frame with the selected dimensions in order to perform the mould duplication.

The peripheral frame (2) mentioned as an example is realized by a profile, such as a closed cylindrical tube (5) but it can, of course, be anything else. Thus, the frame (2) can be realized by any other type of profile, such as those illustrated, for example, in FIGS. 11*a*, 11*b*, 11*c*.

The peripheral frame (2) is realized in the preferred single piece design by a conformed continuous tube (5) but one would not go outside the scope of the invention if it were realized in several pieces or if it were to comprise only one or two profile portions.

It is evident that the central technical bottom piece (15) is a rigid piece, independent of the frame (2), which is attached to said frame by any means, such as riveting, gluing or mould duplication, for example.

It should be added that the central technical piece (15) can be realized of material which is different from the material of the frame. Thus, according to the preferred embodiment, the frame beneficially consists of a tubular metal profile, whereas the central piece is realized of another material, such as, for example, plastic material. It is self-understood that the central piece could be realized in another material such as a metal like aluminum, for example, the same as the frame could be realized in a different material such as a composite material, for example, without going outside the protected field of the invention.

It should be noted that the film (3) is a supple fabric or a plastic film or a film of composite material.

Of course, the invention is not limited to the embodiments described and represented by way of example, but it includes as well as equivalent techniques, including their combinations.

What is claimed is:

1. A snowshoe comprising:

a frame formed by at least a portion of a structural profile;

a central bottom piece made of rigid material in the shape of an elongated plate, the central bottom piece fastened to a central portion of the frame and being disposed only in a central zone of the snowshoe, the central bottom piece further comprising:

at least two mounting portions that complementarily engage opposite sides of frame structural profile at the central portion of the frame, rigid lateral portions extending between the mounting portions and having integral traction enhancing surfaces, and an articulated binding mounting portion; and, a film attached adjacent, front, rear and central portions of the frame.

2. The snowshoe according to claim 1, wherein the frame defines an elongated loop defining a front end, a rear end, and two lateral portions connecting the front and rear ends, the central bottom piece being mounted between the two lateral portions of the frame.

3. The snowshoe according to claim 1, wherein the central bottom piece is disposed, at least in part, in a second horizontal plane situated beneath a first horizontal plane in which the film lies.

4. The snowshoe according to claim 1, wherein the binding mounting portion includes:

an articulated plate supporting the binding for retaining the boot, the plate being pivotally attached to the central bottom piece along a transverse axis.

5. The snowshoe according to claim 2, wherein the frame and the central bottom piece include a contraction in width along the central zone of the deck.

6. The snowshoe according to claim 1, wherein the frame is of different material than the material of the central bottom piece.

7. The snowshoe according to claim 6 wherein the frame is of metal.

8. The snowshoe according to claim 1, wherein the frame is a tubular profile that extends around a periphery of the snowshoe.

9. A process of fabricating the snowshoe according to claim 1, comprising:

making a central bottom piece made of plastic material sized for installation in any of several different sizes of frames having different dimensions, without modifications to its own dimensions.

10. A snowshoe comprising:

a peripheral frame extending around a periphery of the snowshoe, the frame having a front portion, a rear portion, and a central portion;

a central piece connected across the frame in the central portion the central piece and the frame central portion having mating surfaces;

a binding pivotally mounted to the central piece; and a web connected with the forward and rearward portion of the frame and the central piece, the web being received between the frame and central piece mating surfaces.

11. A snowshoe comprising:

a peripheral frame including an elongated metal profile extending around a periphery of the snowshoe, the frame having a front portion, a rear portion, and a central portion;

a central piece connected across the frame in the central portion, the central piece being molded plastic, opposite edges of the central piece being contoured to engage the frame the central portion, ends of the profile being connected together at the rear portion of the frame to hold the frame central portion engaged to the central piece edges;

a binding pivotally mounted to the central piece;

a web connected with the forward and rearward portion of the frame.

12. The snowshoe according to claim 10 wherein:

the central piece includes a traction structure on its lower surface.

13. The snowshoe according to claim 12 wherein the traction structure includes:

a plurality of traverse walls arranged transversely below the central piece; and lateral traction walls arranged along the periphery of the central portion of the snowshoe thereby increasing the support for the user's foot as well as the rigidity and traction properties of the snowshoe.

14. The snowshoe according to claim 11, wherein the central piece includes:

a traction structure on its lower surface.

15. A snowshoe comprising:

a frame formed by at least a portion of a structural profile;

a rigid central bottom piece fastened across a central portion of the frame, the central bottom piece being in the shape of an elongated plate and being disposed only in a central zone of the snowshoe, the central bottom piece further comprising:

at least two mounting portions that complementarily engage opposite sides of frame structural profile at the central portion of the frame, rigid lateral Portions extending between the mounting portions and having integral traction enhancing surfaces, and an articulated binding mounting portion.

16. The snowshoe according to claim 1, wherein a film is attached to the frame central portion by the central bottom piece.

17. The snowshoe according to claim 14 wherein the traction structure is unitarily formed with the central piece.

18. The snowshoe according to claim wherein the integral traction enhancing surfaces include:

a set of lower traction walls extending from the central bottom piece beneath a horizontal plane defined by a lower edge of the frame structural profile.

* * * * *